US007011106B2

(12) United States Patent
Kawolics et al.

(10) Patent No.: US 7,011,106 B2
(45) Date of Patent: Mar. 14, 2006

(54) MODULAR AIR GAP DEVICE AND FAUCET INCLUDING SAME

(75) Inventors: Raymond P. Kawolics, Solon, OH (US); Jeffery J. Labinski, Lakewood, OH (US); Michael A. Kolar, North Royalton, OH (US); Michael H. Meyer, Sagamore Hills, OH (US)

(73) Assignee: The Meyer Company, Cleveland, OH (US)

( * ) Notice: Subject to any disclaimer, the term of this patent is extended or adjusted under 35 U.S.C. 154(b) by 101 days.

(21) Appl. No.: 10/637,135

(22) Filed: Aug. 8, 2003

(65) Prior Publication Data

US 2004/0094202 A1 May 20, 2004

Related U.S. Application Data

(60) Provisional application No. 60/421,730, filed on Oct. 28, 2002, provisional application No. 60/402,506, filed on Aug. 9, 2002.

(51) Int. Cl.
*F16K 24/00* (2006.01)

(52) U.S. Cl. ..... 137/216; 137/801

(58) Field of Classification Search ..... 137/216, 137/801

See application file for complete search history.

(56) References Cited

U.S. PATENT DOCUMENTS

| | | | | |
|---|---|---|---|---|
| 3,794,172 | A | | 2/1974 | Bray |
| 3,967,638 | A | | 7/1976 | Tondreau |
| 4,134,419 | A | | 1/1979 | Richetti |
| 4,210,533 | A | | 7/1980 | Astl |
| 4,454,891 | A | * | 6/1984 | Dreibelbis et al. ..... 137/216 |
| 4,635,673 | A | | 1/1987 | Gerdes |
| 4,771,485 | A | | 9/1988 | Traylor |
| 4,853,117 | A | | 8/1989 | Burrows |
| 4,967,784 | A | | 11/1990 | Barhydt, Sr. et al. |
| 5,020,569 | A | | 6/1991 | Agresta |
| 5,096,574 | A | | 3/1992 | Birdsong et al. |
| 5,127,427 | A | | 7/1992 | Kajpust et al. |
| 5,131,277 | A | | 7/1992 | Birdsong et al. |
| 5,132,017 | A | | 7/1992 | Birdsong et al. |
| 5,305,778 | A | | 4/1994 | Traylor |
| 5,635,058 | A | | 6/1997 | Bowman |
| 5,865,209 | A | | 2/1999 | Vidal |
| 6,524,472 | B1 | | 2/2003 | Monroe |
| 6,524,483 | B1 | | 2/2003 | Monroe |

* cited by examiner

*Primary Examiner*—John Fox
(74) *Attorney, Agent, or Firm*—Fay, Sharpe, Fagan, Minnich & McKee, LLP

(57) ABSTRACT

A modular air gap device adapted for selective insertion into an associated faucet body and comprises a base, an inlet nipple defining an inlet passage and an outlet nipple defining an outlet passage. The inlet and outlet nipples project outwardly from the base in a first direction. An gap structure is connected to the base and projects outwardly therefrom in a second direction opposite the inlet and outlet nipples. The base and air gap structure are adapted for receipt within an air gap chamber of a faucet body. The air gap structure defines a flow path having a first end in direct fluid communication with the inlet passage of the inlet nipple and a second end spaced from the outlet passage of the outlet nipple so that an air gap is defined between the second end of the flow path and the outlet passage. A faucet including the air gap device defines a vent for venting the air gap chamber.

3 Claims, 7 Drawing Sheets

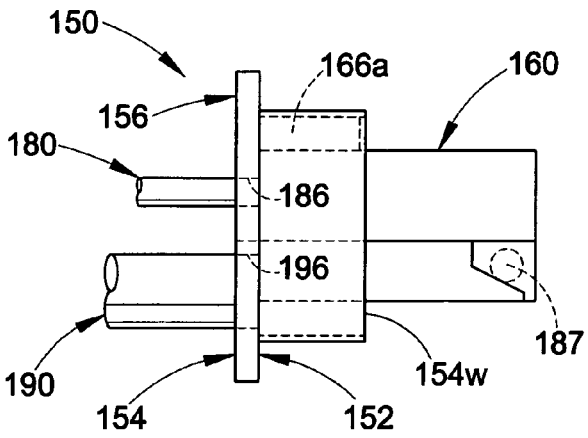
FIG. 15
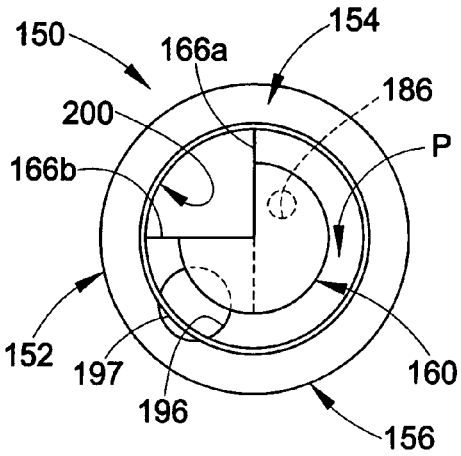
FIG. 13
FIG. 14
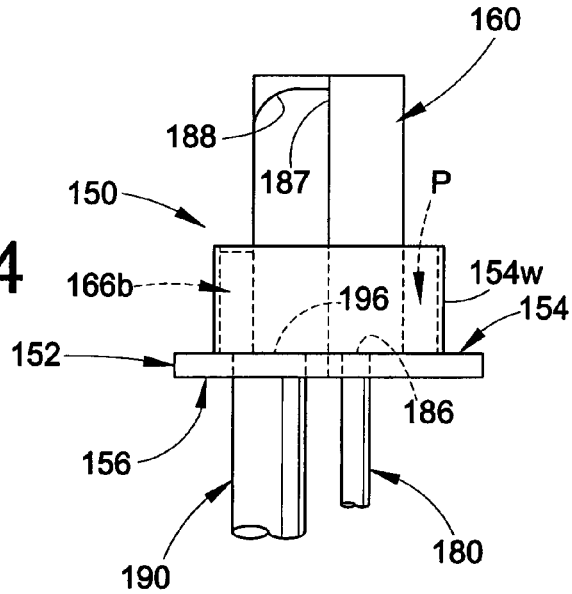
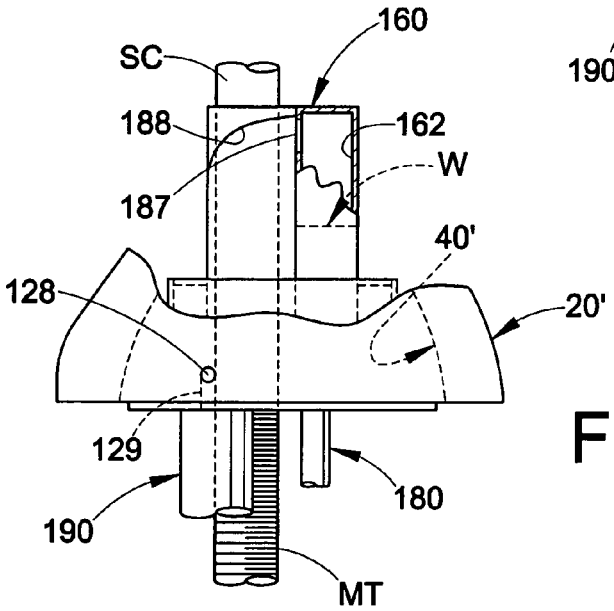
FIG. 16

MODULAR AIR GAP DEVICE AND FAUCET INCLUDING SAME

CROSS-REFERENCE TO RELATED APPLICATIONS

This application claims priority from and benefit of the filing date of U.S. provisional application No. 60/402,506 filed Aug. 9, 2002 and U.S. provisional application No. 60/421,730 filed Oct. 28, 2002, and the disclosures of both said provisional applications are hereby expressly incorporated by reference herein.

BACKGROUND

Air gap devices are well known and in widespread use. These devices are placed in a water line upstream from a drain to prevent siphoning of water from the drain into a water system.

Known air gap devices have been deemed deficient for a variety of reasons. Many known air gap devices are located in a water line in an inconvenient location. Others have been connected to a faucet, but have not been received within the faucet body. As such, these prior faucet-mounted air gap devices have altered the dimensions (e.g., elevation above a mounting surface) and appearance of a faucet.

In light of these drawbacks and others associated with known air gap devices, it has been deemed desirable to develop a modular air gap device and faucet including same, wherein the air gap device is selectively housed within the faucet body, as needed, so that the external appearance of the faucet is unchanged by the installation of the air gap device therein.

SUMMARY OF THE PREFERRED EMBODIMENT

In accordance with a preferred embodiment, a modular air gap device is adapted for selective insertion into an associated faucet body and comprises a base, an inlet nipple defining an inlet passage and an outlet nipple defining an outlet passage. The inlet and outlet nipples project outwardly from the base in a first direction. An air gap structure is connected to the base and projects outwardly therefrom in a second direction opposite the inlet and outlet nipples. The base and air gap structure are adapted for receipt within an air gap chamber of a faucet body. The air gap structure defines a flow path having a first end in direct fluid communication with the inlet passage of the inlet nipple and a second end spaced from the outlet passage of the outlet nipple so that an air gap is defined between the second end of the flow path and the outlet passage.

In accordance with another preferred embodiment, a modular air gap device comprises: (i) a base adapted for receipt within an associated faucet body. The base comprises a first side and an opposite second side. The modular air gap further includes: (ii) a waste water inlet nipple projecting outwardly from the second side of the base and defining a waste water inlet passage projecting; (iii) a waste water outlet nipple projecting outwardly from the second side of the base and defining a waste water outlet passage; and, (iv) a pool defined by a wall extending upwardly from the first side of the base, wherein the waste water outlet passage is in fluid communication with the pool. The device further comprises a conduit comprising a first end in fluid communication with the waste water inlet passage and a second end spaced from and aligned vertically with the pool so that an air gap is defined between the second end of the conduit and the pool so that liquid that flows from the second end of the conduit is received in the pool and flows therefrom via the waste water outlet passage.

In accordance with another preferred embodiment, a faucet comprises a body defining: (i) an inlet; (ii) an outlet; (iii) a valve chamber located fluidically between the inlet and the outlet; (iv) an air gap chamber that opens in a first end of the body; and, (v) a vent defined through a wall of the body into the air gap chamber. A valve is located in the valve chamber to control flow of liquid from the inlet to the outlet. A modular air gap device comprises: (i) a base; (ii) an inlet nipple defining an inlet passage and an outlet nipple defining an outlet passage, wherein the inlet and outlet nipples project outwardly from the base in a first direction; and (iii) an air gap structure connected to the base and projecting outwardly therefrom in a second direction opposite the first direction. The base and the air gap structure are located within the air gap chamber of the body. The air gap structure defines a flow path having a first end in fluid communication with the inlet passage of the inlet nipple and a second end spaced vertically from the outlet passage of the outlet nipple so that an air gap is defined between the second end of the flow path and the outlet passage. The inlet and outlet nipples extend outwardly relative to the first end of the body while the air gap structure is located within the air gap chamber of said body.

In accordance with another embodiment, a faucet comprises a body defining an inlet, an outlet, a valve chamber, and air gap chamber defined between the inlet and a first end of the body. A valve assembly is installed in the valve chamber for controlling flow of liquid from the inlet to the outlet. An air gap device is removably installed within the air gap chamber of the body. The air gap device comprises an inlet nipple and an outlet nipple, wherein both the inlet and outlet nipples extend outwardly from a first end of the body and wherein all portions of the air gap device that are located between the first end of the body and the inlet are housed completely within the air gap chamber of the body. The air gap device is selectively removable from the air gap chamber of the body without altering an external appearance of the body.

BRIEF DESCRIPTION OF THE DRAWINGS

The invention comprises various components and arrangements of components, preferred embodiments of which are illustrated in the accompanying drawings that form a part herein and wherein:

FIG. 13 is a top plan view of an alternative modular air gap device formed in accordance with the present invention;

FIG. 14 is a front elevational view of the modular air gap device shown in FIG. 13;

FIG. 15 is a side elevational view of the modular air gap device shown in FIG. 13; and, FIG. 16 is a view similar to FIG. 14 but shows the modular air gap device installed in a faucet body in accordance with the present invention, with portions of the faucet body and air gap device broken away.

DETAILED DESCRIPTION OF PREFERRED EMBODIMENTS

FIGS. 1–4 illustrate a faucet body 20 defined from metal, plastic or the like and including a liquid inlet 22 and a liquid outlet 24. The inlet 22 and outlet 24 are threaded or otherwise adapted to mate in a fluid-tight manner with conventional conduit and/or fittings.

Figure 5A:
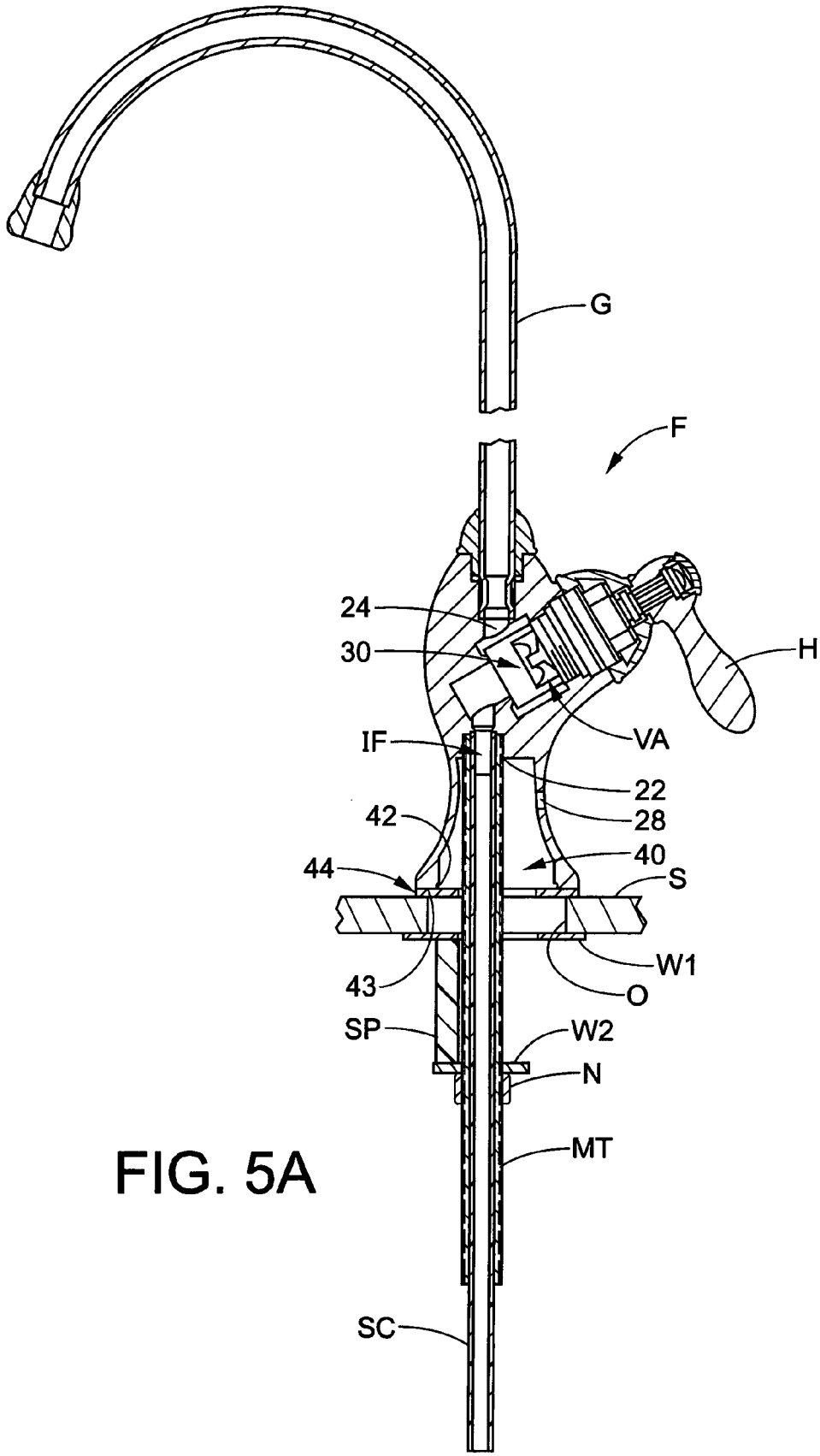
FIG. 5A is a sectional view of a complete faucet assembly adapted to receive a modular air gap device formed in accordance with the present invention.

As shown in FIG. 5A, a gooseneck outlet conduit G is mated with the outlet 24. A mounting tube MT is mated with the inlet 22. A plastic or other supply conduit SC extends through the mounting tube MT and includes a fitting IF at its inner end that is secured in said inlet 22 by said mounting tube MT.

With continuing reference to FIGS. 1–5A, the body 20 defines a valve chamber 30 including an open mouth 32 that is also threaded. The valve chamber 30 fluidically interconnects the inlet 22 and outlet 24. The valve chamber 30 is conformed to receive a valve assembly VA (FIG. 5A) such as a conventional ¼-turn ceramic disk cartridge valve assembly or any other suitable conventional valve assembly that controls and selectively blocks liquid flow from the inlet 22 to the outlet 24. In the illustrated embodiment, the valve assembly VA threadably mates with the threads defined by the mouth 32.

Figure 5B:
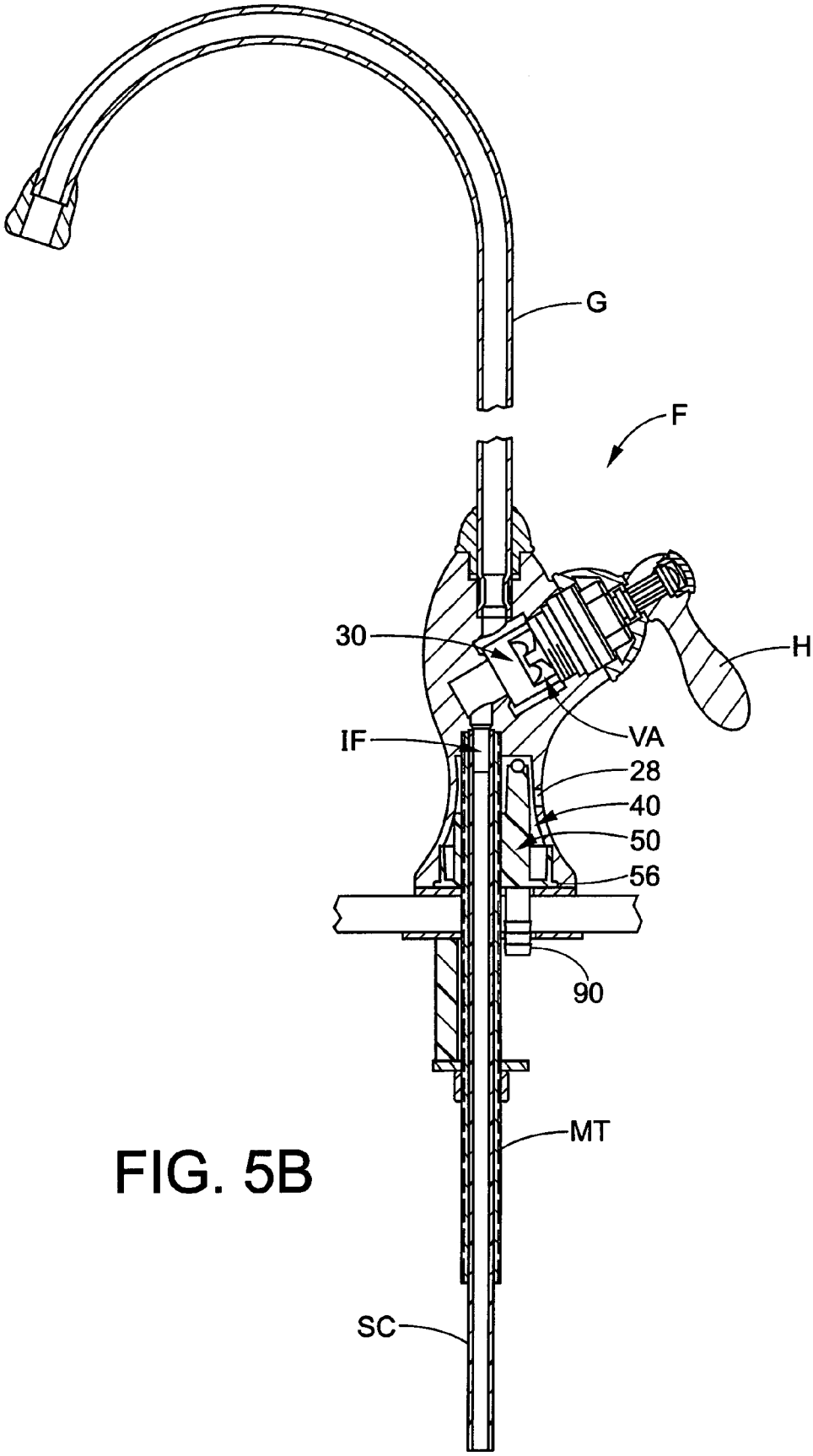
FIG. 5B is identical to FIG. 5A but shows a modular air gap device installed within the faucet assembly in accordance with the present invention.
Figure 7:
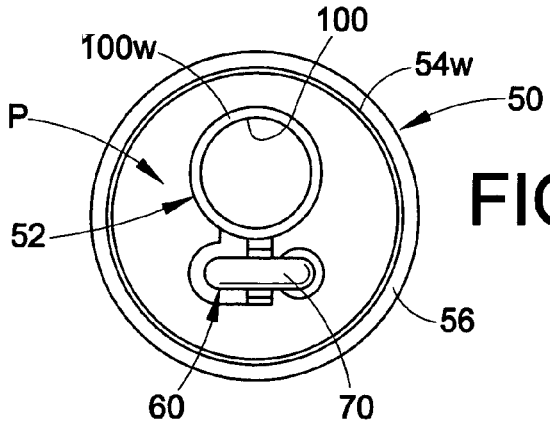
FIG. 7 is a top plan view of the modular air gap device shown in FIG. 6.
Figure 6:
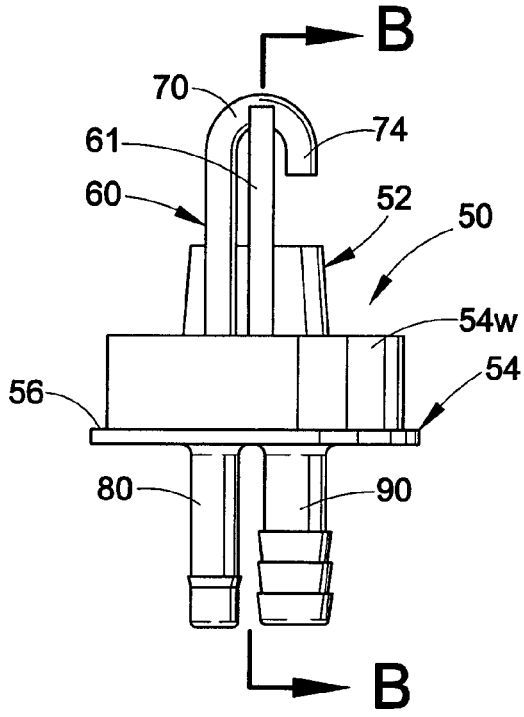
FIG. 6 is a front elevational view of a modular air gap device formed in accordance with the present invention.
Figure 8:
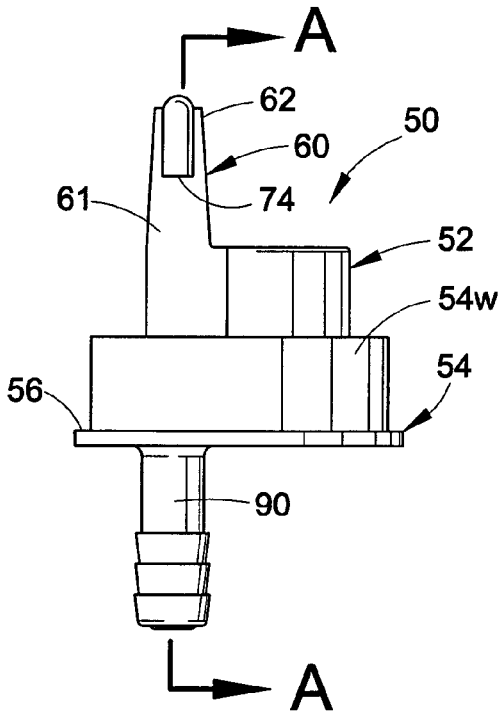
FIG. 8 is a side elevational view of the modular air gap device shown in FIG. 6.
Figure 9:
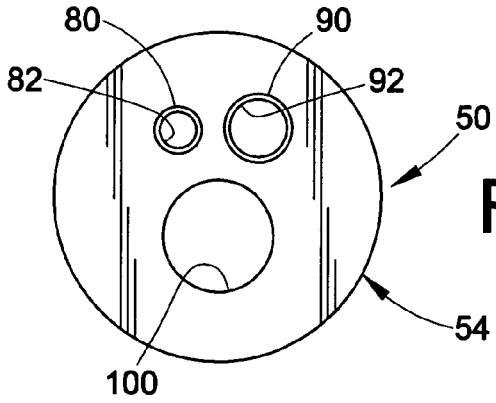
FIG. 9 is a bottom plan view of the modular air gap device shown in FIG. 6.

The faucet body 20 further defines a hollow air gap chamber 40. The air gap chamber 40 includes a mouth 42 that opens in a first end 44 of the body 20, and the chamber extends from the mouth 42 toward the inlet 22. The body 20 preferably defines a vent opening 28 that intersects the air gap chamber 40. The vent opening 28 is typically required when a modular air gap device 50 (FIGS. 6–11) is operatively installed in the chamber 40 as described below and as shown in FIG. 5B. A removable cap (not shown) is used to block the vent opening 28 when venting of the chamber 40 is not required.

A faucet assembly F comprising the body 20 is illustrated in FIG. 5A. The faucet assembly F is adapted to be mounted to a sink S or other support surface. In particular, the mounting tube MT including the supply conduit SC is inserted through an opening O defined in the sink S so that the first end 44 of the body 20 mates with the sink S or an intermediate gasket such as a rubber washer or other gasket member 43 that is preferably positioned between the first end 44 of the body 20 and the sink S as shown. On the underside of the sink S or other mounting structure, a first washer W1, spacer SP, second washer W2 and nut N (or another suitable arrangement of fastening members) are used to clamp the faucet assembly F to the sink S as shown when the nut N is threaded onto the mounting tube MT. Of course, the supply conduit SC is connected to a source of water or other liquid so that same flows into the inlet 22 and from there to the outlet 24 via valve chamber 30 as controlled by valve assembly VA. Valve assembly VA comprises a handle H by which a user manually opens and closes the valve assembly.

FIG. 5B illustrates the faucet assembly F and further shows a modular air gap device 50 formed in accordance with the present invention operatively installed in the chamber 40 of the faucet body 20. In the preferred embodiment, the modular air gap device 50 is simply placed in the chamber 40 as shown in FIG. 5B and is trapped and held therein when the faucet body 20 is mated with a sink S, counter-top or other support surface when installed as described above in relation to FIG. 5A, i.e., the sink or other mounting structure blocks the mouth 42 of the air gap chamber 40. It is important to compare FIGS. 5A and 5B and note that the modular air gap device 50 does not alter the appearance or dimensions of the body 20 or position of the faucet body 20 same relative to sink S or other mounting surface.

The modular air gap device 50 is shown separately in FIGS. 6–12 and comprises a body 52 preferably defined from molded plastic or another suitable material. The body 52 is preferably one-piece and comprises a base 54 dimensioned and conformed to be at least partially received in the mouth 42 of the chamber 40 of the faucet body 20. The base 54 defines a flange 56 adapted to engage the faucet body 20 when the device 50 is operatively installed in the chamber 40.

The body 52 of the air gap device 50 further comprises an air gap structure 60 projecting outwardly from a first side of the base 54. A wall **54*w* also projects outwardly from the first side of the base 54 and defines an open-top pool P. As shown, the wall 54*w* at least partially encircles the air gap structure 60**.

In the illustrated embodiment, the air gap structure 60 comprises a vertically extending support member 61 projecting outwardly from the base 54. The support member 61 defines a recessed distal end 62. The air gap structure 60 further comprises an air gap conduit or tube 70 that is seated in the recessed distal end 62 of the support member 61. The conduit 70 is preferably a metal tubular member that is assembled to the body 52 of the device 50 but can be a molded plastic member and can be defined as a one-piece construction with the remainder of the air gap structure 60.

Figure 10:
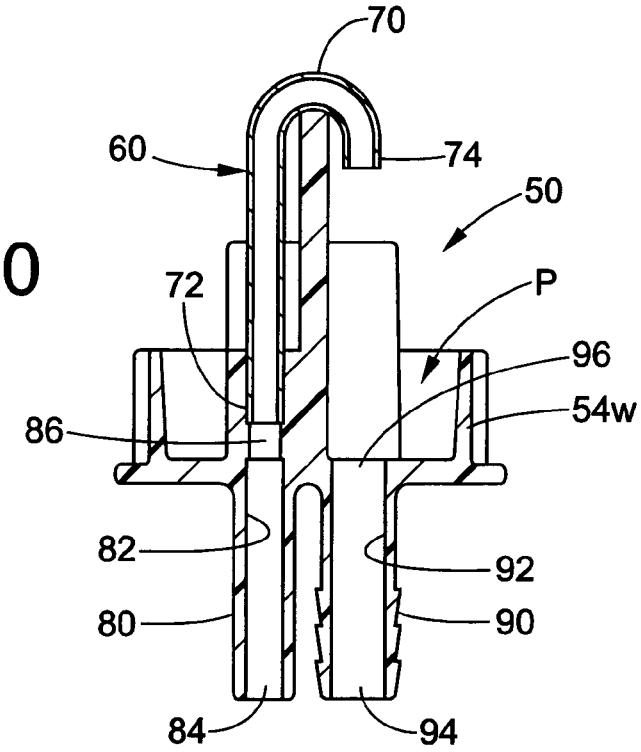
FIG. 10 is a sectional view taken along line A—A of FIG. 8.
Figure 11:
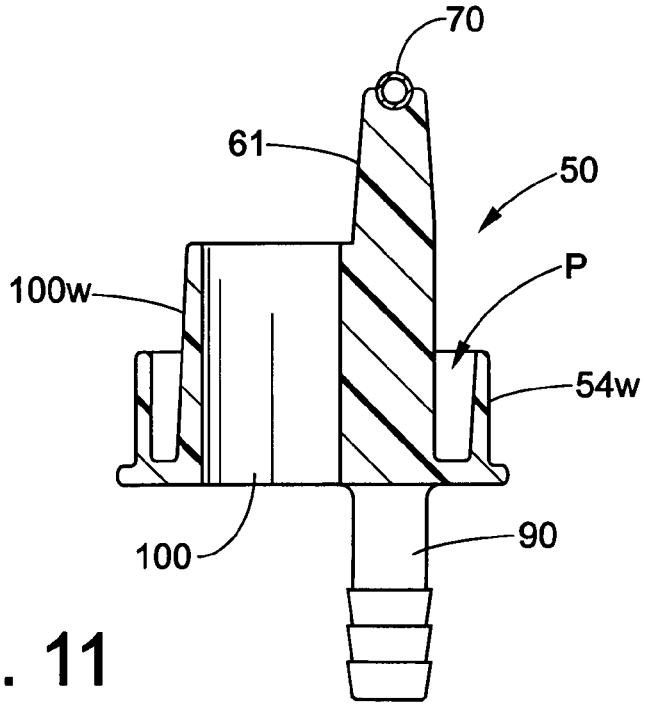
FIG. 11 is a sectional view taken along line B—B of FIG. 6.
Figure 12:
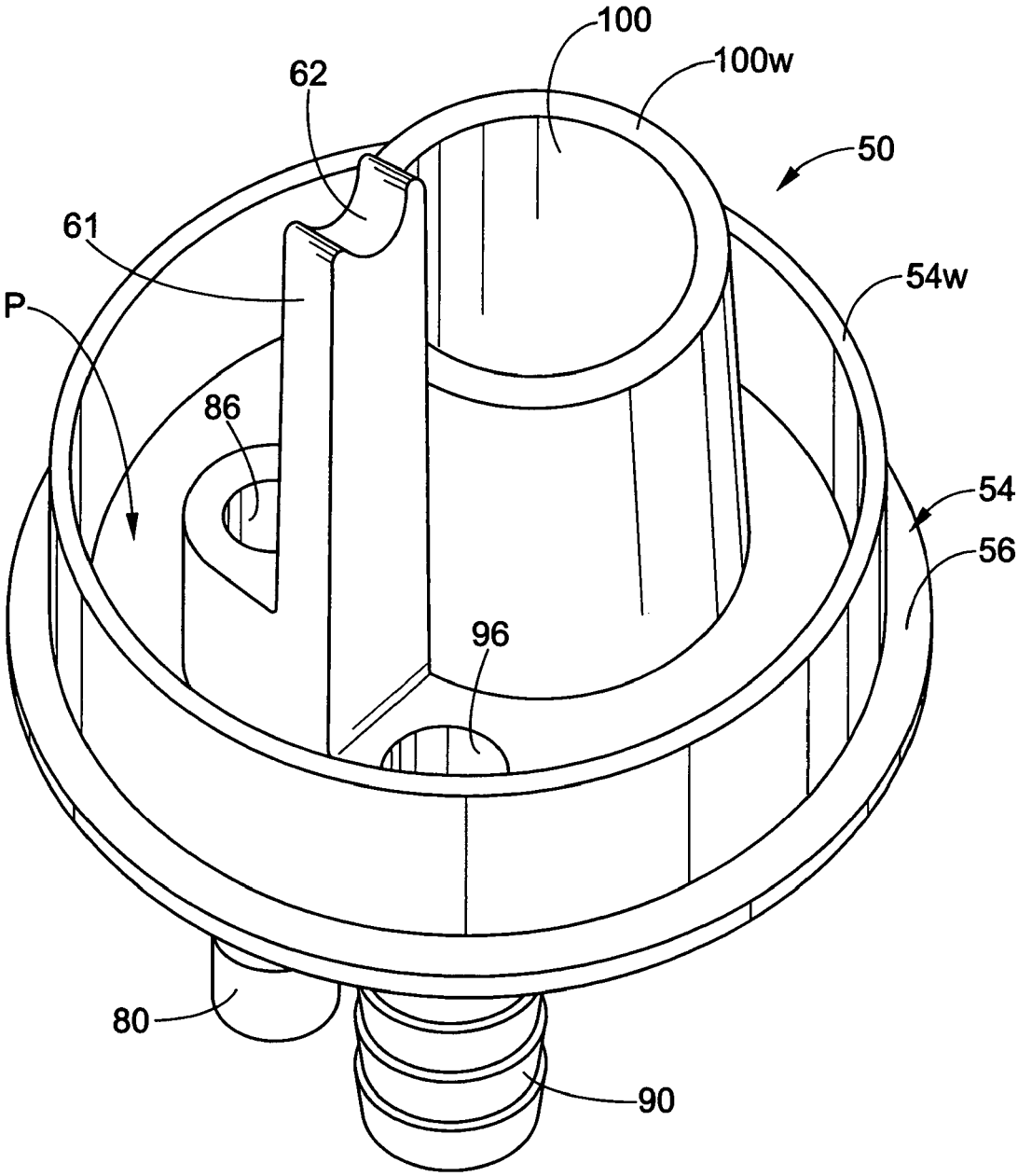
FIG. 12 is a perspective illustration of the modular air gap device of FIG. 6.

The body 52 further defines a waste water inlet nipple 80 projecting outwardly from a second side of the base 54 in a direction opposite that in which the air gap structure 60 projects. A waste water inlet passage 82 extends through the inlet nipple 80. The waste water inlet passage 82 includes in inlet port 84 and an outlet port 86 (FIG. 10). A waste water supply line (not shown) is connected to the inlet nipple 80.

Similarly, the body 52 defines a waste water outlet nipple 90 projecting outwardly from a second side of the base 54 in a direction opposite that in which the air gap structure 60 projects. A waste water outlet passage 92 extends through the outlet nipple 90. The waste water outlet passage 92 includes an inlet port 96 and an outlet port 94 (FIG. 10), and the inlet port 96 opens in the pool P, preferably at a lowest point thereof so that all liquid held in the pool P drains by gravity into outlet passage 92 via port 96.

The air gap conduit or tube 70 of the air gap structure 60 is defined from a J-shaped hollow tubular conduit member. The tube 70 comprises a first end 72 that is received with a close friction fit in the outlet port 86 of the waste water inlet passage 82. The air gap tube 70 further comprises a second end 74 that is vertically aligned with but spaced from the pool P and preferably also is aligned with the inlet port 96 of the waste water outlet passage 92. As such, liquid flowing from second end 74 of tube 70 flows into the pool P and drains therefrom via port 96 and outlet passage 92 of outlet nipple 90 (of course a drain conduit is connected to the outlet nipple 90 to flow the waste water therefrom to a drain or other location).

An "air gap" (i.e., an open space) is thus defined between the second end 74 of the air gap tube 70 and the waste water inlet port 96, i.e., waste water that flows into the waste water inlet passage 82 and through the tube 70 must move through the open space defined between the second end 74 of the tube 70 and the inlet 96 of the waste water outlet passage 92. The air gap tube 70 is engaged with the recessed distal end 62 of the support member 61 so that the support member 61 holds the tube 70 in the described operative position. The air gap tube 70 is secured in the described operative position by adhesive or a friction fit or otherwise. Although the air gap tube 70 is shown herein as a separate metal conduit member that is connected to the body 52, the air gap tube 70 can alternatively be defined as an integral and/or one-piece part of the body 52 without departing from the overall scope and intent of the present invention.

With continuing reference to FIGS. 6–11, the modular air gap body 52 further defines a through-bore 100 dimensioned and positioned to receive the mounting tube MT as shown in FIG. 5B. A wall 100*w* surrounds the through-bore 100 so that liquid in the pool P cannot flow into the bore 100, i.e., the wall 54*w* defines an outer wall of the pool P while the wall 100*w* defines an inner wall of the pool P.

The modular air gap device 50 is selectively installed in the air gap chamber 40 of faucet body 20 when use of an air gap device is required as shown in FIG. 5B. More particularly, the modular air gap device 50 is slidably installed into the chamber 40 with the mounting conduit MT inserted into the bore 100 of the air gap body 52. On the other hand, if no air gap function is required for a particular installation, the faucet body 20 is usable without having the modular air gap device 50 operatively installed as shown in FIG. 5A.

It is important to note that the modular air gap device 50 is releasably installed in the chamber 40 and is removable therefrom as desired. Also, of course, the bore 100 is only one example of a structure for accommodating the mounting tube MT when the modular air gap device 50 is operatively installed, and the air gap body 52 can be otherwise conformed without the bore 100 so that it is receivable into the mouth 42 of the chamber 40 adjacent the mounting tube MT as described.

Figure 2:
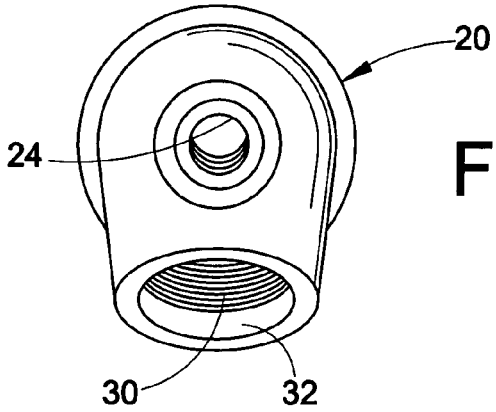
FIG. 2 is a top plan view of the faucet body shown in FIG. 1.
Figure 1:
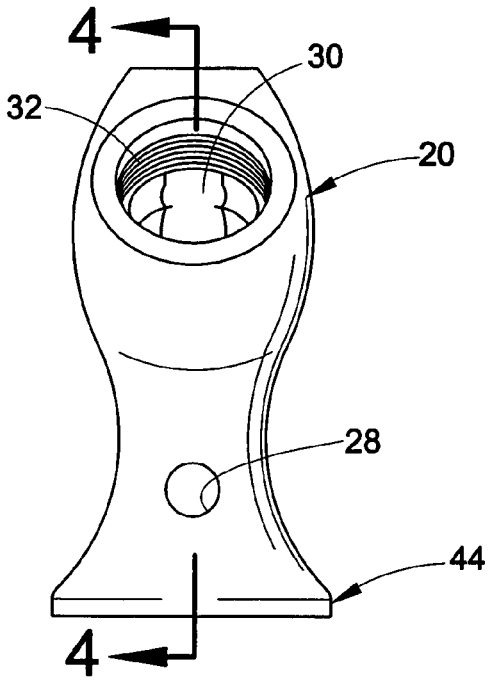
FIG. 1 is a front elevational view of a faucet body conformed to receive a modular air gap device in accordance with the present invention.
Figure 4:
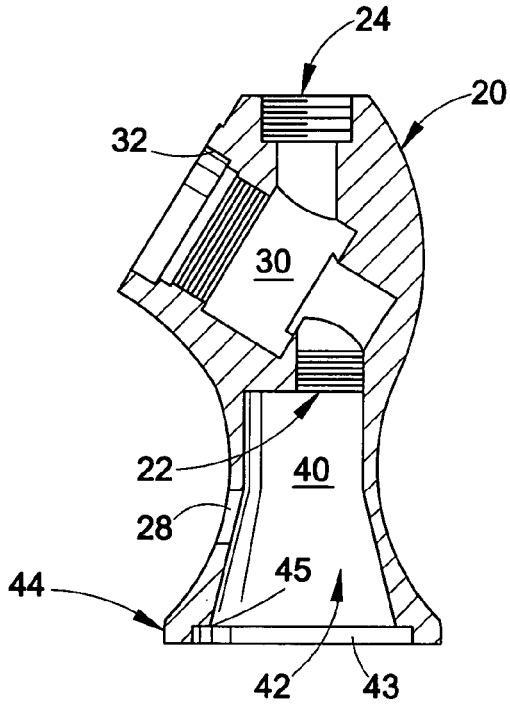
FIG. 4 is a sectional view taken along line 4—4 of FIG. 1.
Figure 3:
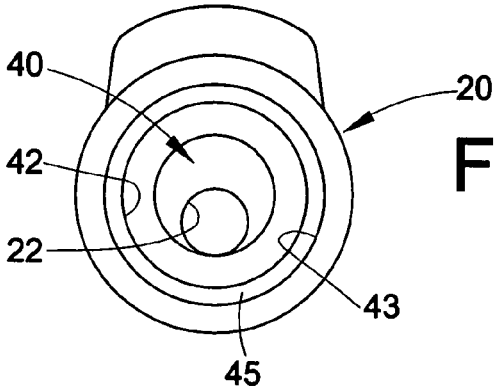
FIG. 3 is a bottom view of the faucet body shown in FIG. 1.

Referring to FIGS. 3 and 4, the mouth 42 of air gap chamber 40 is preferably defined to include a recess or counter-bore 43 that receives the flange 56 of the air gap device 50 so that the flange 56 is flush with or recessed into the first end 44 of the body (see FIG. 5B). The flange 56 abuts a shoulder 45 formed by the inner end of the counter-bore 43 when the air gap device 50 is fully installed into the chamber 40. As such, in the preferred embodiment as illustrated, only the nipples 80, 90 of the air gap device 50 are located external of faucet body 20 and these are not visible when the faucet assembly F is operatively installed in a sink S or other location such as a countertop, i.e., all portions of air gap device 50 located between the first end 44 of the faucet body 20 and the inlet 22 of faucet body 20 are located within the air gap chamber 40 so as not to be visible above the sink S or other mounting structure.

Referring now to FIGS. 13–16, an alternative modular air gap device formed in accordance with the present invention is illustrated generally at 150. Except as shown and/or described, the modular air gap device 150 is identical in structure and use to the modular air gap device 50 just described. As such, features of the device 150 that are the same or correspond to features of the device 50 are identified by reference numbers that are 100 higher than those used in FIGS. 1–12; new features are identified with new reference numerals.

The modular air gap 150 includes a molded plastic body 152 comprising a base 154 and a flange 156 that projects radially outward from the base. Extending axially from a first side of the base 154, the body 152 comprises an elongated air gap structure 160 that defines an interior hollow chamber or reservoir 162 (FIG. 16).

It should be noted that the base 154 defines an annular wall structure 154*w* that preferably surrounds the elongated air gap structure 160 and defines a pool P. Walls 166*a*,166*b* define opposite ends of the pool P so that water will be trapped in the pool P and not flow into the opening 200 (which corresponds to the opening 100 shown in FIGS. 1–12) provided for passage of the mounting tube MT as shown in FIG. 16.

The elongated air gap structure 160 defining the chamber 162 defines an inlet 186 and an outlet 187 (FIGS. 15, 16) spaced axially from the inlet 186 (in use the outlet 187 is spaced above the inlet 186). A waste water inlet conduit 180 communicates with the inlet 186 so that waste water flows under some pressure into the chamber 162 via conduit 180 and inlet 186. When the level of waste water W (FIG. 16) in the chamber 162 reaches the outlet 187, the waste water flows out of the outlet 187 and trickles or flows by gravity into the pool P. A water deflector 188 is provided externally adjacent the outlet 187 to ensure that water flowing out of the outlet is directed downwardly into the pool P. The chamber 162 and water W in the chamber 162 muffle noise associated with flow of waste water through the air gap device 150.

The body 152 further defines a waste water drain 196 that is in communication with the pool P. A waste water outlet conduit 190 is in communication with the drain 196 so that waste water in the pool P flows by gravity into the drain 196 and conduit 190. In can be seen that an air gap is thus defined between the outlet 187 of the chamber 162 and the drain 196 as required.

The drain 196 is vented to improve flow and reduce noise. More particularly, a vent passage 197 (FIG. 13) is defined by the body 152. The vent passage 197 communicates air into the outlet conduit 190 from a location outside the pool P.

FIG. 16 illustrates the modular air gap device 150 installed in a faucet body 20'. The faucet body 20' is identical to the faucet body 20 except that it further defines a vent passage 129 that opens to the ambient atmosphere through an opening 128. The vent passage 129 is located so that it is in fluid communication with the vent passage 197 of the air gap device 150 when the air gap device 150 is operatively installed in the faucet body 20' as shown. As such, ambient air flows into the waste water outlet conduit 190 through the opening 128, passage 129 and passage 197 when waste water flows out of the pool P through the drain 196 to improve flow and reduce noise or "rumbling."

FIG. 16 also shows that the mounting tube MT passes through the space 200 defined by the modular air gap device 150 when the device 150 is operatively installed in the faucet body. It should be noted that the air gap device 150 is removably connected to the faucet body 20'.

Using a modular air gap device 50,150 formed in accordance with the present invention, no portion of the air gap structure 60,160 thereof is located outside of the air gap chamber 40 of the faucet body 20,20'. As such, the dimensions and appearance of the body 20,20' are not altered when a modular air gap device 50,150 is installed into the air gap chamber 40. Only the nipples 80,90; 180,190 are located external to the air gap chamber 40, and these are not visible when the faucet F is operatively installed in a sink S or other support structure.

The invention has been described with reference to preferred embodiments. Modifications and alterations will occur to those of ordinary skill in the art to which the invention pertains, and it is intended that the invention be construed as including all such modifications and alterations.

What is claimed is:

1. A faucet comprising:

a body defining: (i) an inlet; (ii) an outlet; (iii) a valve chamber located fluidically between said inlet and said outlet; (iv) an air gap chamber that opens in a first end of said body; and, (v) a vent defined through a wall of said body into said air gap chamber;

a valve located in said valve chamber to control flow of liquid from said inlet to said outlet;

a modular air gap device comprising: (i) a base; (ii) an inlet nipple defining an inlet passage and an outlet nipple defining an outlet passage, said inlet and outlet nipples projecting outwardly from said base in a first direction; and (iii) an air gap structure connected to said base and projecting outwardly therefrom in a second direction opposite the first direction, wherein said base and said air gap structure are located within said air gap chamber of said body, said air gap structure defining a flow path having a first end in fluid communication with said inlet passage of said inlet nipple and a second end spaced vertically from said outlet passage of said outlet nipple so that an air gap is defined between said second end of said flow path and said outlet passage, and wherein said inlet and outlet nipples extend outwardly relative to said first end of said body while said air gap structure is located within said air gap chamber of said body.

2. The faucet as set forth in claim 1, wherein said air gap chamber is partially defined by a counter-bore defined in said first end of said body, and wherein said base of said modular air gap device comprises a flange that is received within said counter-bore so that said flange is flush with or recessed into said first end of said body.

3. A faucet comprising:

a body defining an inlet, an outlet, a valve chamber, and air gap chamber defined between said inlet and a first end of said body, wherein said inlet is located in said air gap chamber;

a water supply conduit connected to said inlet and extending through said air gap chamber and outwardly from said first end of said body;

a valve assembly installed in said valve chamber for controlling flow of liquid from said inlet to said outlet;

an air gap device removably installed within said air gap chamber of said body, said air gap device comprising an inlet nipple and an outlet nipple, wherein both said inlet and outlet nipples extend outwardly from the first end of said body and wherein said body defines a vent opening that allows air flow into said air gap chamber from a location external to said body, said air gap device selectively removable from said air gap chamber of said body without altering an external appearance of said body.

* * * * *